US006364555B1

(12) United States Patent
Kerr

(10) Patent No.: US 6,364,555 B1
(45) Date of Patent: Apr. 2, 2002

(54) METHOD AND APPARATUS FOR BEARING HUB ALIGNMENT IN PRINT ENGINE CHASSIS

(75) Inventor: Roger S. Kerr, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/579,382

(22) Filed: May 26, 2000

(51) Int. Cl.[7] ..... B41J 3/39
(52) U.S. Cl. ..... 400/691; 400/693
(58) Field of Search ..... 400/691, 692, 400/693.1, 694, 693; 347/222, 243, 245

(56) References Cited

U.S. PATENT DOCUMENTS

| | | | | |
|---|---|---|---|---|
| 4,425,171 A | | 1/1984 | Oosaka et al. | |
| 4,451,186 A | | 5/1984 | Payne | |
| 4,557,171 A | | 12/1985 | Stolzer | |
| 4,593,587 A | | 6/1986 | Nenadal | |
| 4,616,944 A | * | 10/1986 | Galatha et al. | 400/692 |
| 4,693,642 A | | 9/1987 | Mair et al. | |
| 4,723,857 A | * | 2/1988 | Yokoi | 400/693 |
| 4,825,022 A | * | 4/1989 | Butts | 200/343 |
| 4,846,595 A | * | 7/1989 | Kato et al. | 400/320 |
| 4,979,850 A | | 12/1990 | Dompe | |
| 5,110,283 A | | 5/1992 | Bluml et al. | |
| 5,268,708 A | | 12/1993 | Harshbarger et al. | |
| 5,415,610 A | | 5/1995 | Schutz et al. | |
| 5,678,291 A | | 10/1997 | Braun | |
| 5,765,818 A | | 6/1998 | Sabatino et al. | |
| 5,775,825 A | * | 7/1998 | Hong et al. | 400/693 |
| 6,084,622 A | * | 7/2000 | Sugiura et al. | 347/170 |

* cited by examiner

*Primary Examiner*—Ren Yan
*Assistant Examiner*—Darius N. Cone
(74) *Attorney, Agent, or Firm*—Nelson Adrian Blish

(57) ABSTRACT

A method of aligning a bearing hub in a print engine chassis supporting an imaging drum (14) provides a right wall positioned near a first end of the imaging drum (14) and has a first cavity near the first end of the imaging drum (14). The present invention also provides a left wall positioned near a second end of the imaging drum (14), the left wall substantially parallel to said right wall, wherein the left wall has a second cavity near the second end of the imaging drum. A self-hardening filler material (54) is poured into the first and second cavities. A right bearing hub (52) is positioned for the imaging drum (14) into the filler material (54) within the first cavity prior to hardening of the filler material (14). A left bearing hub (50) is positioned for the imaging drum (14) into the filler material (54) within the second cavity prior to hardening of the filler material (54). Alignment of the left bearing hub (50) with the right bearing hub (52) is needed.

12 Claims, 9 Drawing Sheets

METHOD AND APPARATUS FOR BEARING HUB ALIGNMENT IN PRINT ENGINE CHASSIS

CROSS REFERENCE TO RELATED APPLICATIONS

Reference is made to commonly-assigned copending U.S. patent application Ser. No. 09/493,920, filed Jan. 28, 2000, entitled 'A PRINT ENGINE CHASSIS FOR SUPPORTING A VACUUM IMAGING DRUM', by Roger S. Kerr. U.S. patent application Ser. No. 09/499,813, filed Feb. 8, 2000, entitled 'A PRINT ENGINE CHASSIS HAVING A ADJUSTABLE SIDEWALL THICKNESS', by Roger S. Kerr. U.S. patent application Ser. No. 09/504,552, filed Feb. 15, 2000, entitled 'A PRINT ENGINE CHASSIS FOR SUPPORTING AN IMAGING DRUM AND PRINTHEAD TRANSLATION ASSEMBLY', by Roger S. Kerr.

FIELD OF THE INVENTION

This invention relates in general to a color proofing apparatus and method of manufacture and more particularly to alignment of a bearing hub in a print engine chassis.

BACKGROUND OF THE INVENTION

Pre-press color proofing is a procedure used by the printing industry for creating representative images of printed material. This procedure avoids the high cost and time required to produce printing plates and also avoids setting-up a high-speed, high-volume printing press to produce a representative sample of an intended image for proofing. Otherwise, in the absence of pre-press proofing, a production run may require several corrections and must be reproduced several times to satisfy customer requirements. This results in lost profits. By utilizing pre-press color proofing, time and money are saved.

A laser thermal printer having half-tone color proofing capabilities is disclosed in commonly assigned U.S. Pat. No. 5,268,708 titled "Laser Thermal Printer With An Automatic Material Supply" issued Dec. 7, 1993 in the name of R. Jack Harshbarger, et al. The Harshbarger, et al. device is capable of forming an image on a sheet of thermal print media by transferring dye from a roll of dye donor material to the thermal print media. This is achieved by applying thermal energy to the dye donor material to form the image on the thermal print media. This apparatus generally comprises a material supply assembly, a lathe bed scanning subsystem (which includes a lathe bed scanning frame, a translation drive, a translation stage member, a laser printhead, and a rotatable vacuum imaging drum), and exit transports for thermal print media and dye donor material.

The operation of the Harshbarger, et al. apparatus comprises metering a length of the thermal print media (in roll form) from a material supply assembly. The thermal print media is then measured and cut into sheet form of the required length, transported to the vacuum imaging drum, registered, and then wrapped around and secured onto the vacuum imaging drum. Next, a length of dye donor roll material is also metered out of the material supply assembly, measured and cut into sheet form of the required length. The cut sheet of dye donor roll material is then transported to and wrapped around the vacuum imaging drum, such that it is superposed in registration with the thermal print media, which at this point has already been secured to the vacuum imaging drum. The drum is rotated past the printhead and the translation drive traverses the printhead and translation stage member axially along the rotating vacuum imaging drum in coordinated motion with the rotating vacuum imaging drum. These movements combine to produce the image on the thermal print media. After the intended image has been written on the thermal print media, the dye donor material is removed from the vacuum imaging drum without disturbing the thermal print media. Additional dye donor materials are sequentially superposed with the thermal print media on the vacuum imaging drum, then imaged onto the thermal print media as previously mentioned, until the intended full-color image is completed.

Although the printer disclosed in the Harshbarger, et al. patent performs well, there is a long-felt need to reduce manufacturing costs for this type of printer and for similar types of imaging apparatus. With respect to the lathe bed scanning frame disclosed in the Harshbarger, et al. patent, the machined casting used as the frame represents significant cost relative to the overall cost of the printer. Cost factors include the design and fabrication of the molds, the casting operation, and subsequent machining needed in order to achieve the precision necessary for a lathe bed scanning engine used in a printer of this type. Castings can be complex to model, making it difficult to use tools such as finite element analysis to predict the suitability of a design. Moreover, due to shrinkage, porosity, and other manufacturing anomalies, careful mold maintenance may be required in order to obtain uniform results when casting multiple frames. In the assembly operation, each frame casting must be individually assessed for its suitability to manufacturing standards and must be individually machined. Further, castings also exhibit frequency response behavior due to resonant frequencies, which are difficult to analyze or predict. For this reason, the task of identifying and reducing vibration effects can require considerable work and experimentation. Additionally, the overall amount of time required between completion of a design and delivery of a prototype casting can be several weeks or months.

The combined weight of the imaging drum, motor and encoder components, and printhead translation assembly components, plus the inertial forces applied when starting and stopping the drum require a frame having substantial structural strength. For this reason, a sheet metal frame would not be considered to provide a solution. Alternative methods used for frame fabrication have been tried, with some success. For example, welded frame structures have been used. However, these welded structures can require significant expense in manufacture. Welded structures can be adversely affected by stress induced by the welding process, causing warping.

Other alternatives to metal castings have been used by manufacturers of machine tools. In particular, castable polymers, manufactured under a number of trade names, have been employed to provide support structures that are equivalent to castings for apparatus such as machine tool beds and optical tables. These castable polymers also provide improved performance when compared with castings, with respect to expansion and contraction due to heat and with respect to vibration damping.

Castable polymers have been employed to provide substitute structures for metal castings and weldments. One example is disclosed in U.S. Pat. No. 5,415,610 (Schutz et al.) which discloses a frame for machine tools using castable concrete to form a single casting of a bed and a vertical wall for a machine tool. U.S. Pat. No. 5,678,291 (Braun) and 5,110,283 (Bluml et al.) are just two of a number of examples in which castable polymer concrete is used as a machine tool bed or for mounting guide rails in machining environments. Castable polymers are also used in the machine tool environment for damping mechanisms, as is disclosed in U.S. Pat. No. 5,765,818 (Sabatino et al.)

Castable polymers provide a number of advantages, including the ability to mount support components of the chassis directly in the castable material when it is still soft. Various types of fasteners, tubing, or other components can be cast in place, or can even be inserted into the castable polymer before it hardens. Of particular difficulty, however, is the precision placement of support components within the castable polymer material. In order to precisely position a component within such a material used as filler in a chassis, it is necessary to employ some type of temporary fixture or jig to hold the component in place temporarily during the hardening process. This positioning problem is compounded when it is necessary to mount two or more support components that must be axially aligned with respect to each other, such as the bearing hubs that support each end of an imaging drum.

Conventional alternatives for mounting right and left bearing hubs in precise placement with respect to each other include machining. After casting, machining operations such as boring and line honing or even line boring can be employed. As disclosed in U.S. Pat. Nos. 4,451,186 (Payne), 4,979,850 (Dompe), and 4,693,642 (Mair et al.), line boring machinery and techniques are employed for engine blocks and other precision castings. Line boring equipment, as described in these patents, solves the difficult problem of boring holes on opposite side walls of a chassis or engine, where axial alignment must be within very tight tolerances. However, line boring equipment is very expensive and requires building of specialized jigs and supports.

Components can be mounted in a castable concrete polymer that holds them in position, as is disclosed for attachment elements in a band saw in U.S. Pat. No. 4,557,171 (Stolzer). By the nature of castable fillers, precision positioning can be effected. For example, U.S. Pat. No. 4,425,171 (Oosaka et al.) discloses use of a substantially non-fluid bonding component (for example, epoxies) for precision positioning. The methods and materials disclosed in the Oosaka patent are intended primarily for service with lightweight optical components. These can be positioned by hand, as noted in the Oosaka et al. patent disclosure. However, such manual positioning methods cannot be suitably applied for mounting bearing hubs in precise alignment, since the bearing hubs have considerable mass relative to the devices noted in the Oosaka et al. patent. Moreover, bearing hubs require a jig or fixture so that when in position, these components are axially aligned. On a larger scale, U.S. Pat. No. 4,593,587 (Nenadal) discloses mounting of a way block in precise position on the bed of a machine tool using a castable filler material and employing a temporary fixture to secure this component in place during hardening. However, neither the Oosaka et al. nor the Nenadal patents address the more complex problem of positioning multiple components having axial alignment.

There has been a long-felt need to reduce the cost and complexity of printer fabrication without compromising the structural strength required for the lathe bed scanning assembly. While use of castable polymers provides an alternative to the use of conventional castings or weldments, the problem of precision positioning of support components when using castable materials requires cost-effective and reliable solutions.

SUMMARY OF THE INVENTION

It is an object of the present invention to provide an apparatus and a method for a bearing hub alignment in a print engine chassis, where the chassis uses side walls comprising a castable material.

According to one aspect of the present invention a method of aligning a bearing hub in a print engine chassis supporting an imaging drum provides a right wall positioned near a first end of the imaging drum and has a first cavity near the first end of the imaging drum. The present invention also provides a left wall positioned near a second end of the imaging drum, the left wall substantially parallel to said right wall, wherein the left wall has a second cavity near the second end of the imaging drum. A self-hardening filler material is poured into the first and second cavities. A right bearing hub is positioned for the imaging drum into the filler material within the first cavity prior to hardening of the filler material. A left bearing hub is positioned for the imaging drum into the filler material within the second cavity prior to hardening of the filler material. Alignment of the left bearing hub with the right bearing hub is needed.

According to one embodiment of the present invention, a precision mandrel is employed to axially align the bearing hubs, the mandrel itself supported on a fixture. A jackscrew positions the bearing hub on the mandrel before casting with filler material to allow removal of the mandrel when the filler material hardens.

A feature of the present invention is the provision of a print engine chassis comprising a filler material, wherein split bearing hubs are used to support bearings for the imaging drum, the bearing hubs themselves rigidly set in castable filler material.

An advantage of the present invention is that it eliminates the need for precision line boring machining for the purpose of creating axially aligned bores in facing chassis walls. Instead, modular split bores are set in castable filler material during chassis fabrication.

Yet another advantage of the present invention is that parts can be added to a chassis during assembly, at the time the castable polymer filling is applied. This saves cost over machining and allows changes to be easily incorporated into the design.

The invention and its objects and advantages will become more apparent in the detailed description of the preferred embodiment presented below.

DETAILED DESCRIPTION OF THE INVENTION

The present description will be directed in particular to elements forming part of, or cooperating more directly with, apparatus in accordance with the invention. It is to be understood that elements not specifically shown or described may take various forms well known to those skilled in the art.

Figure 1:
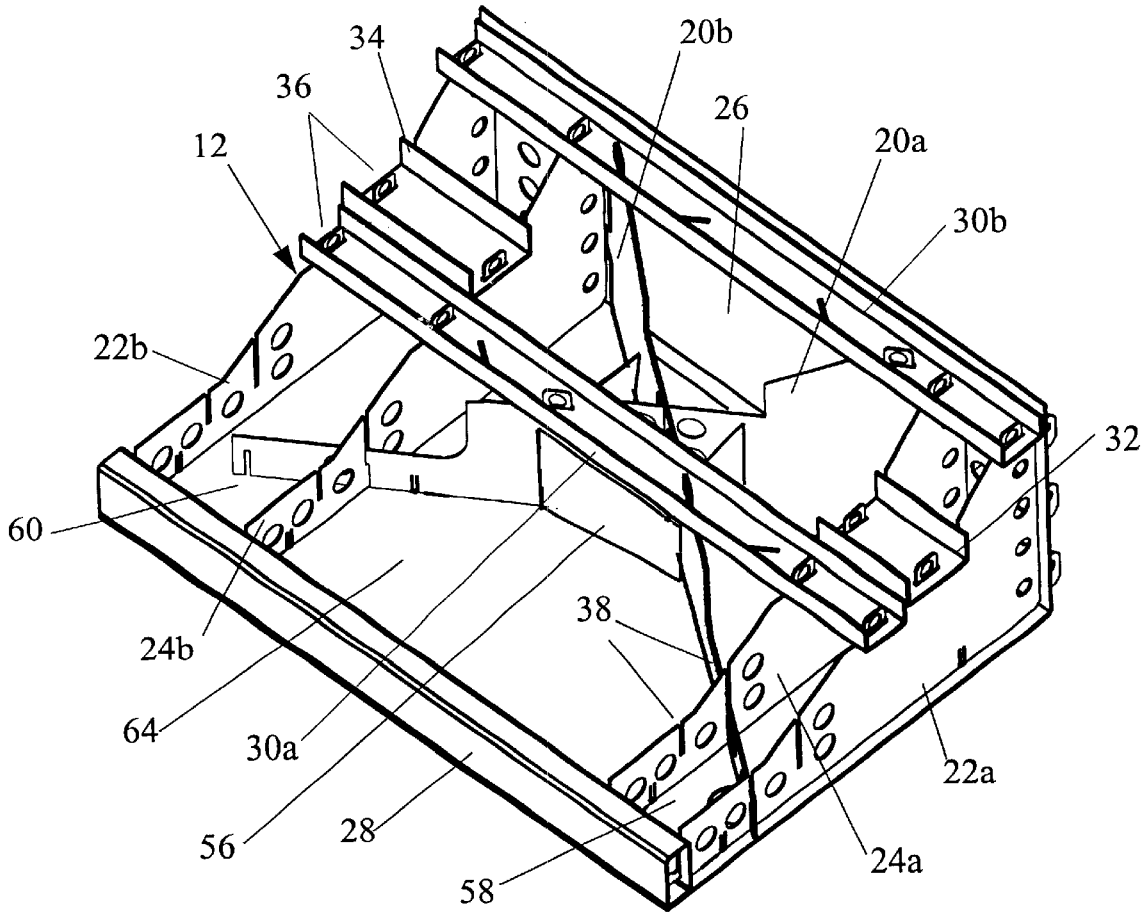
FIG. 1 is a perspective view of a sheet metal structure in the preferred embodiment of this invention.

Referring to FIG. 1, there is shown a sheet metal frame 12 that forms a skeleton for the chassis of a print engine. In the preferred embodiment, sheet steel of 0.090 in. thickness (nominal) is used to provide strength. Sheet steel members can be cut from stock using laser cutting techniques, well known in the sheet metal art.

Sheet metal frame 12 comprises side walls 22*a* and 22*b*, inner walls 24*a* and 24*b*, a rear wall 26, and a front member 28 atop a base 64. Sheet metal frame 12 further comprises supporting and bracing structures provided by full-length cross-struts 30*a* and 30*b* and cross braces 20*a* and 20*b*. A left cross-strut 34 spans between side wall 22*b* and inner wall 24*b*. A right cross-strut 32 spans between side wall 22*a* and inner wall 24*a*.

The sheet metal structures that form sheet metal frame 12 are joined using slot-and-tab construction. At each junction of sheet metal members, a slot 38 is provided. In this arrangement, slot 38 mates with a corresponding slot 38 on a joining member, or slot 38 is fitted to a tab 36. A bracing box 56 having a slot at each vertical corner fits about the junction of cross braces 20*a* and 20*b*. Side wall 22*a* and inner wall 24*a* form a right side cavity 58. Side wall 22*b* and inner wall 24*b* form a left side cavity 60.

Using an arrangement of sheet metal members configured as is shown in FIG. 1, it can be seen that a design can be implemented that allows use of the same members for different print engine configurations. For example, inner wall 24*a* could be disposed further to the left within sheet metal frame 12. This might be preferable, for example, where the weight of supported motor structures requires additional support. By cutting additional slots into front member 28, cross braces 20*a* and 20*b*, and rear wall 26, inner wall 24*a* could be suitably repositioned in a number of different locations, at different distances from side wall 22*a*. Alternately, the overall dimensions of sheet metal frame 12 could be altered while using many of the same sheet metal members. For example, the length of a chassis frame could be changed simply by altering the lengths of full-length cross strut 30*a*, front member 28, and rear wall 26.

Figure 2:
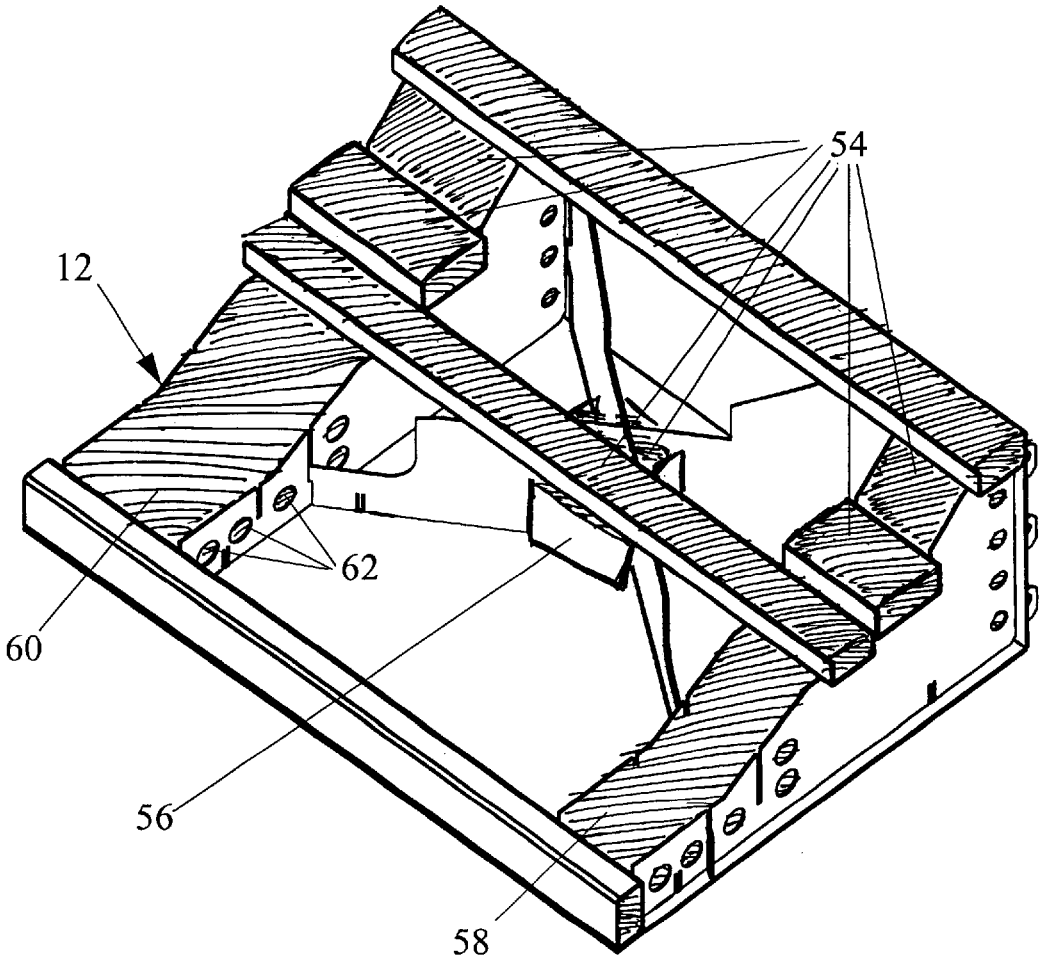
FIG. 2 is a perspective view of a sheet metal structure with a filler material poured into selected cavities.

FIG. 2 shows sheet metal frame 12 reinforced using the method of the present invention. A filler material 54 is poured into left side and right side cavities 60 and 58, into bracing box 56, and into troughs formed by left cross-strut 34, full-length cross-struts 30*a* and 30*b*, and right cross strut 32 within sheet metal frame 12. Filler material 54 is also poured into front member 28. Filler material 54 hardens and locks sheet metal members of sheet metal frame 12 rigidly into place.

Filler material 54 is preferably a castable polymer concrete, such as SUPER ALLOY Polymer Concrete manufactured by Philadelphia Resins, located in Montgomeryville, Pa. Castable polymer substances such as the "SUPER ALLOY" mixture provide a stable structure for the print engine chassis. For print engine applications, castable polymer concrete is particularly well suited, since this substance provides excellent vibration damping. Moreover, since aggregate size can be changed, castable polymer concrete can be modified to optimize vibration response characteristics for specific equipment applications.

The process of pouring the castable polymer requires a minimum of preparation. Holes 62 in sheet metal members are taped in order to trap the castable polymer within a cavity until hardening. Slotted junctions are also be taped in preparation for pouring.

In the preferred embodiment, tabs 36 include holes to allow flow-through of the castable polymer when poured. Upon hardening, a channel of the castable polymer fills the hole, further locking tab 36 into place.

Referring again to FIGS. 1 and 2, it is noted that various mounting components can be embedded within the castable polymer concrete. When the castable polymer concrete hardens, embedded components are locked into position. This technique is used for parts that require precision alignment, effectively using the castable polymer concrete to lock components precisely into place. Tubing may also be inserted within a cavity to allow routing of wires or air flow circulation through the polymer concrete material.

Figure 3:
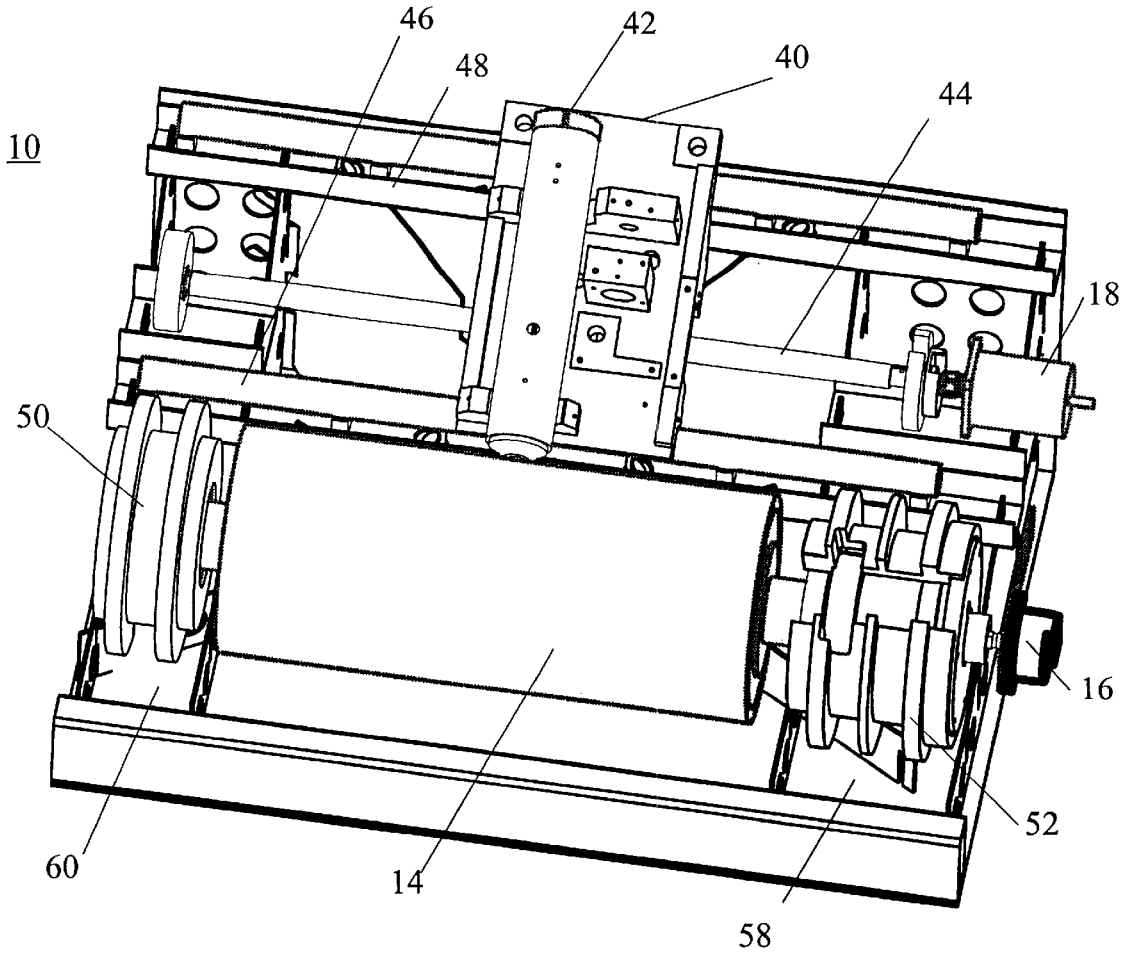
FIG. 3 is a perspective view of a print engine having an imaging drum, printhead translation assembly, and associated motors.

Referring to FIG. 3, there is shown a print engine 10 having an imaging drum 14, driven by a drum motor 16. Drum 14 is mounted to rotate within a left bearing hub 50 and a right bearing hub 52 that support drum bearings (not shown). Both left bearing hub 50 and right bearing hub 52 are held in place by the castable polymer concrete that acts as filler material 54 within right side cavity 58 and left side cavity 60. A translation motor 18 drives a printhead transport 40 containing a printhead 42 by means of a lead screw 44. A front guide rail 46 and a rear guide rail 48 support printhead transport 40 over its course of travel from left to right as viewed in FIG. 3. Referring again to FIG. 3, it can be seen that the design of sheet metal frame 12, reinforced by filler material 54 as disclosed herein, allows a flexible arrangement of components for print engine 10.

Figure 4:
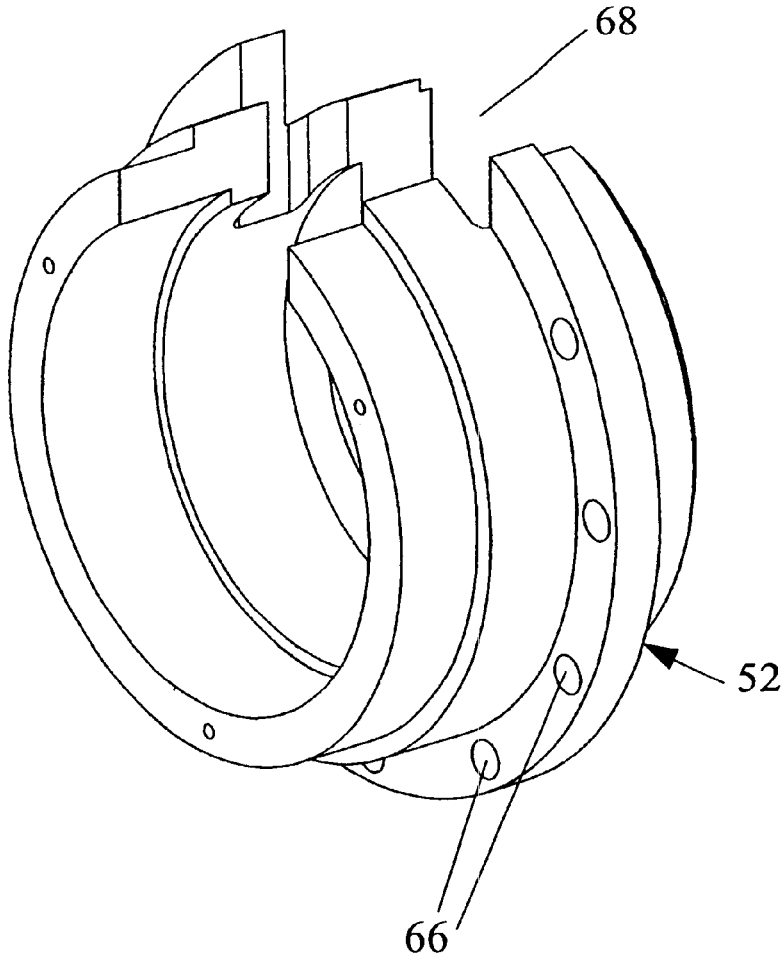
FIG. 4 is a perspective view of a bearing hub of the present invention.
Figure 5:
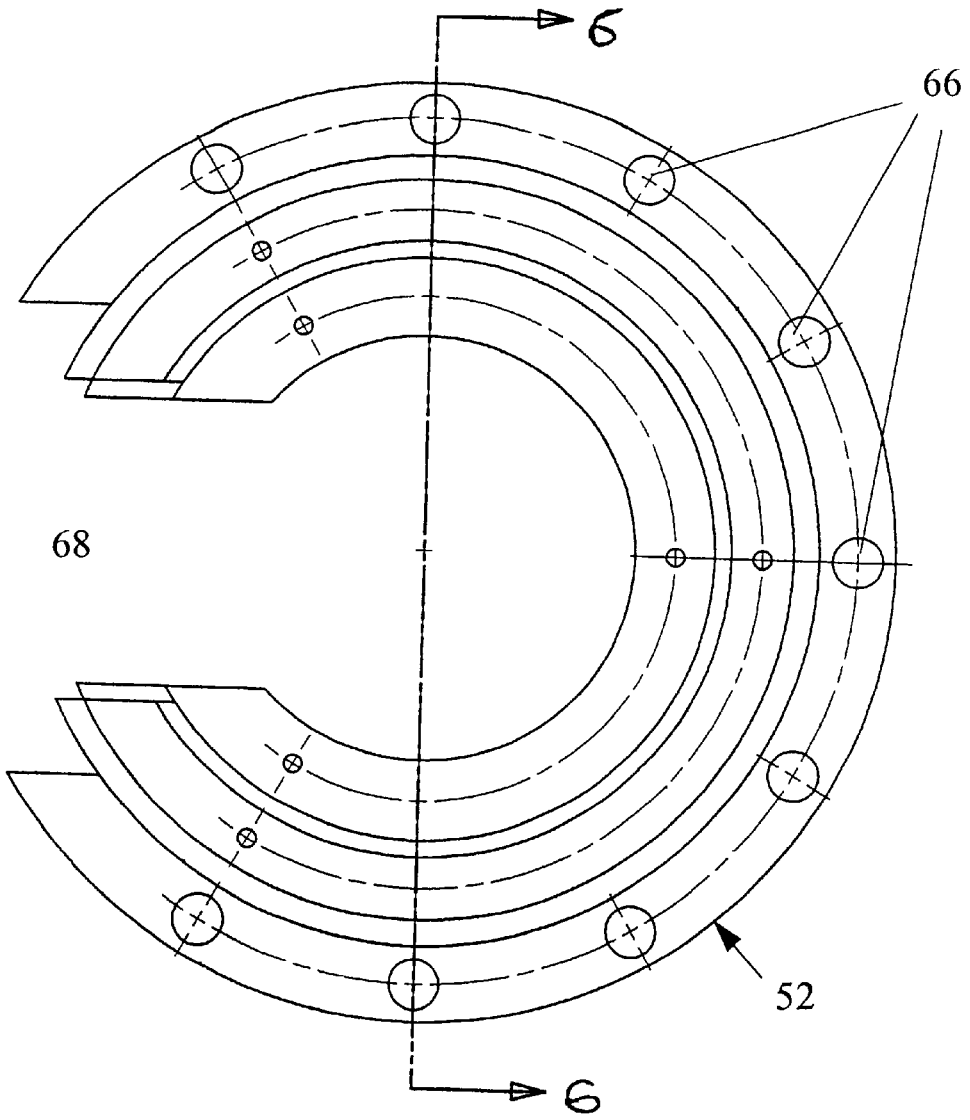
FIG. 5 is a flat side view of the bearing hub shown in FIG. 4.
Figure 6:
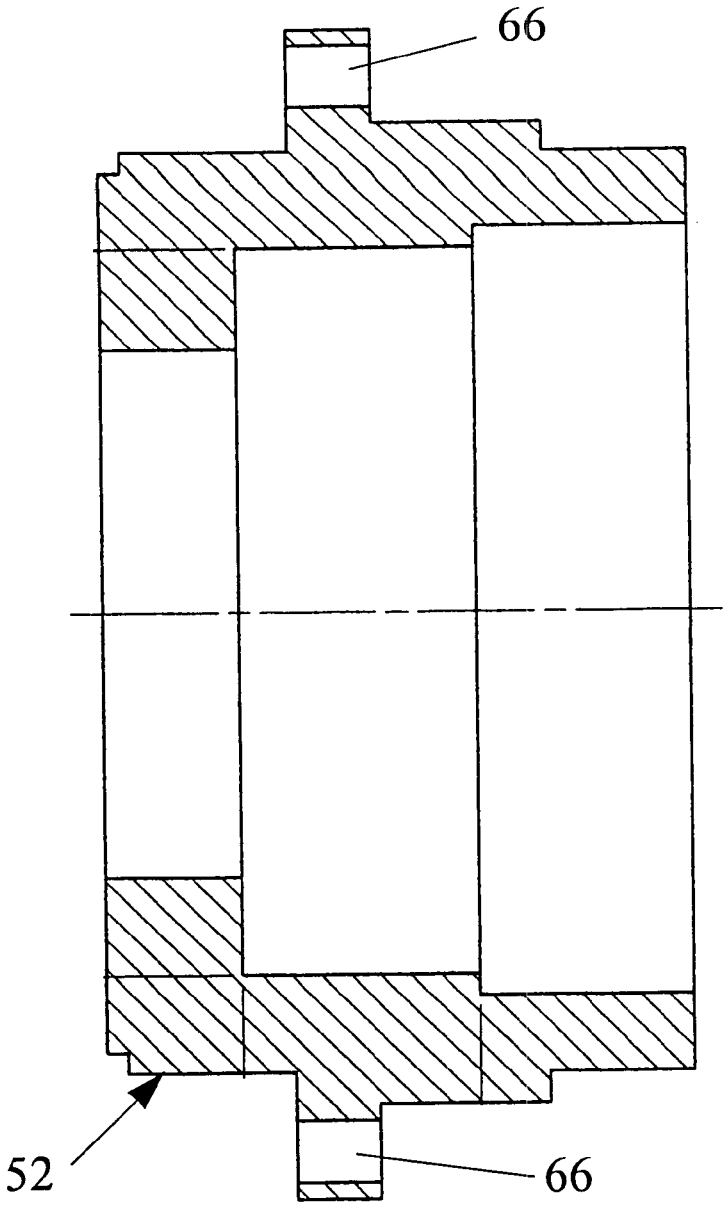
FIG. 6 is a cross-sectional along lines 6—6 view of the bearing hub of FIG. 5.

FIG. 4 shows right bearing hub 52 in perspective view. Right bearing hub 52 is cast from steel in the preferred embodiment, and is machined to provide a split section 68 for allowing the seating of imaging drum 14. Through holes 66 are provided in bearing hub 52 for filling by castable filler material 54, as is described subsequently. FIG. 5 shows a flat side view of right bearing hub 52. FIG. 6 shows a cross-section view of right bearing hub 52 taken across section 6—6 marked in FIG. 5.

After the castable polymer is set, bearing hub 52 is held in position by filler material 54. Left bearing hub 50 is also held in position by filler material 54. In the preferred embodiment, left bearing hub 50 is also split; however, left bearing hub 54 could be continuous, as shown in FIG. 3.

Axial Alignment

Figure 7:
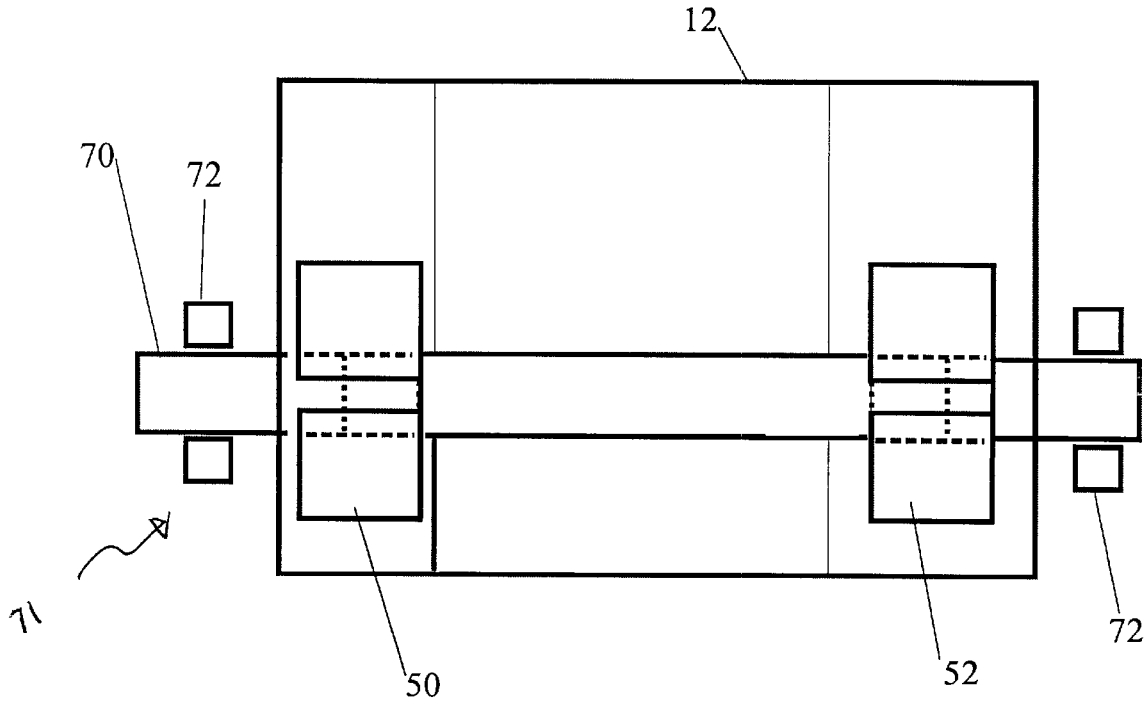
FIG. 7 is a top plan view showing a fixture used for bearing hub alignment during fabrication.
Figure 8:
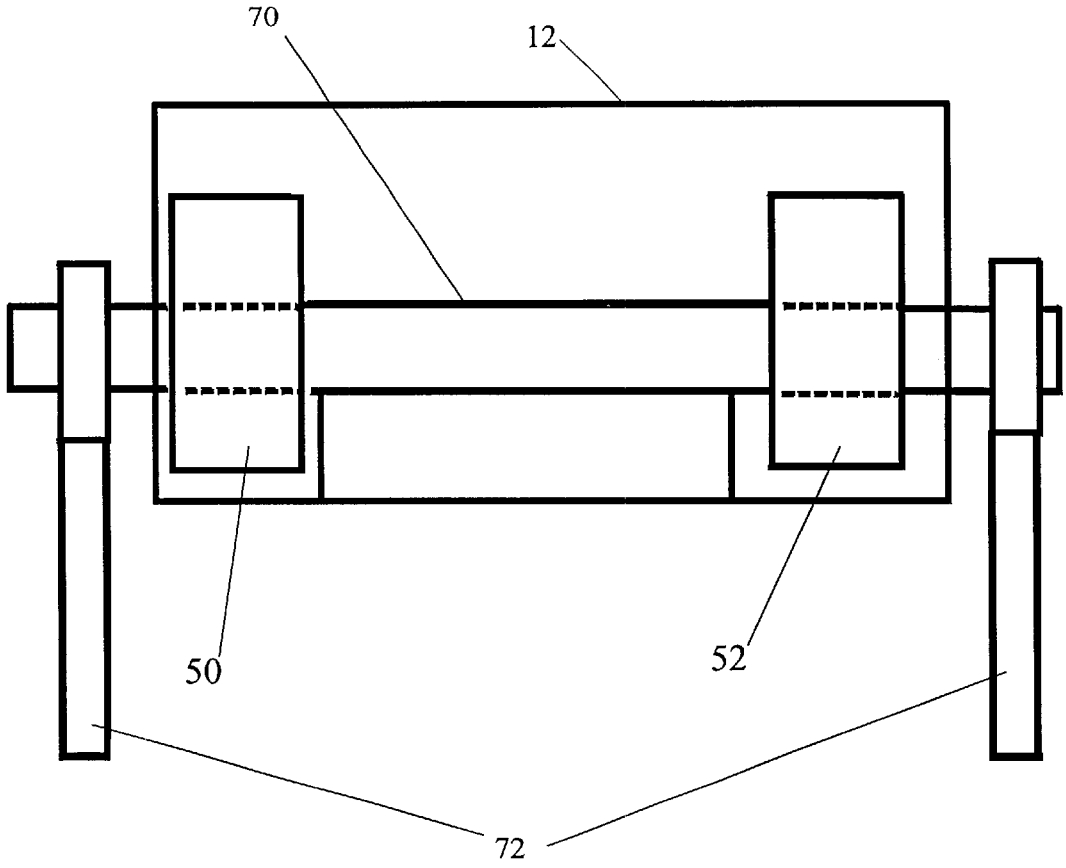
FIG. 8 is a side view showing the fixture used for bearing hub alignment.

Both left bearing hub 50 and right bearing hub 52 must be axially aligned to properly hold imaging drum 14. In order to achieve this alignment, a fixture 71, shown in the top view of FIG. 7 and side view of FIG. 8, is used. Fixture 71 is comprised of a mandrel 70 and y-shaped brackets 72. Mandrel 70 is precision-machined to serve as an alignment element. Y-shaped brackets 72 are disposed on either side of sheet metal frame 12 to hold mandrel 70 level and at the correct height for bearing hub 50 and 52 alignment.

Figure 9:
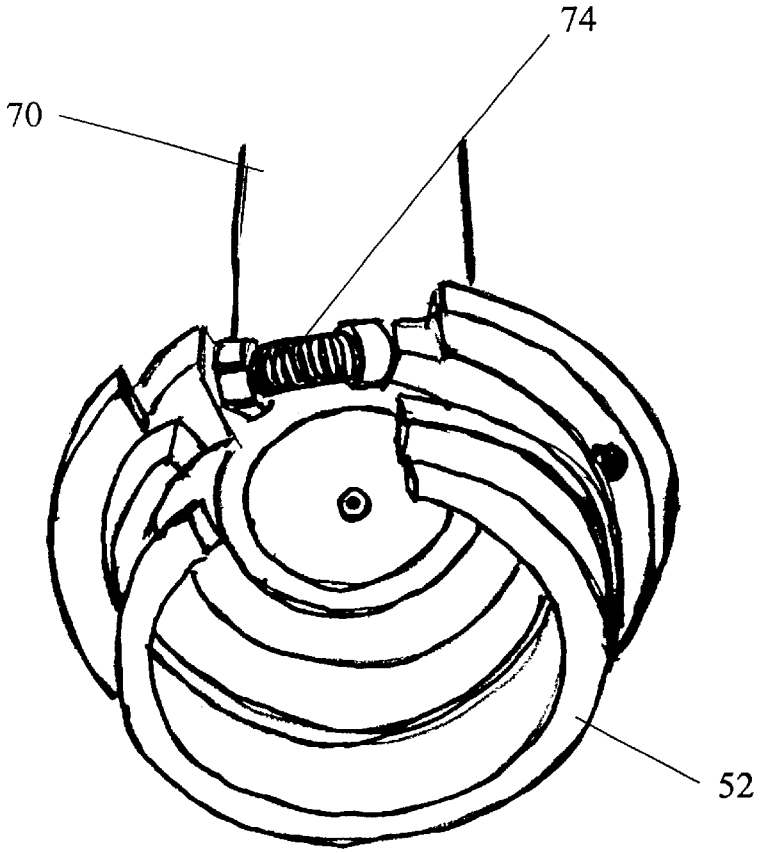
FIG. 9 is a perspective view of a jackscrew positioned within the bearing hub.

To load split bearing hubs 50 and 52 onto mandrel 70, a jackscrew 74 is inserted within a split section 68 as shown in FIG. 9. Jackscrew 74 spreads split section 68 slightly to allow fitting of hubs 50 and 52 onto mandrel 70. Jackscrew 74 is removed when hubs 50 and 52 are properly positioned. Filler material 54 is then poured into cavities in sheet metal frame 12.

When filler material 54 hardens, mandrel 70 must be removed. Jackscrews 74 are reinserted and spread split section 68 in both bearing hubs 50 and 52, thereby providing clearance for the removal of mandrel 70. Through-holes 66 in bearing hubs 50 and 52 are filled with filler material 54 when poured. The hardened filler material 54 locks bearing hubs 50 and 52 in place and prevents shifting that might otherwise reduce the dimension of split section 68.

While the invention has been described with particular reference to its preferred embodiments, it will be understood by those skilled in the art that various changes may be made and equivalents may be substituted for elements of the preferred embodiments without departing from the invention. For example, a number of different formulations could be used for filler material 54. Bearing hubs 50 and 52 could have a number of possible configurations. The fixture 71 provided by mandrel 70 and brackets 72 could be constructed using a number of alternate schemes. Jackscrew 74 could be replaced by a number of different structures serving the same purpose.

PARTS LIST

10. Print engine
12. Sheet metal frame
14. Imaging drum
16. Drum motor
18. Translation motor
20*a*. Cross-brace
20*b*. Cross-brace
22*a*. Side wall
22*b*. Side wall
24*a*. Inner wall
24*b*. Inner wall
26. Rear wall
28. Front member
30*a*. Full-length cross-strut
30*b*. Full-length cross-strut
32. Right cross-strut
34. Left cross-strut
36. Tab
38. Slot
40. Printhead transport
42. Printhead
44. Lead screw
46. Front guide rail
48. Rear guide rail
50. Left bearing hub
52. Right bearing hub
54. Filler material
56. Bracing box
58. Right side cavity
60. Left side cavity
62. Holes
64. Base
66. Through-hole
68. Split section
70. Mandrel
71. Fixture
72. Brackets
74. Jackscrew

What is claimed is:

1. A method of aligning a bearing hub in a print engine chassis for supporting an imaging drum comprising the steps of:

providing a right wall positioned near a first end of said imaging drum and having a first cavity near said first end of said imaging drum;

providing a left wall positioned near a second end of said imaging drum, said left wall substantially parallel to said right wall, wherein said left wall has a second cavity near said second end of said imaging drum;

pouring a self-hardening filler material into said first and second cavities;

positioning a right bearing hub for said imaging drum into said filler material within said first cavity prior to hardening of said filler material;

positioning a left bearing hub for said imaging drum into said filler material within said second cavity prior to hardening of said filler material; and aligning said left bearing hub with said right bearing hub.

2. A method as in claim 1 wherein a mandrel is inserted in said right bearing hub and said second bearing hub for alignment of said hubs.

3. The method of claim 1 wherein said right bearing hub is a split bearing hub.

4. The method of claim 3 wherein said right bearing hub is split by a jackscrew prior to insertion of a mandrel for alignment of said right bearing hub and said left bearing hub.

5. The method of claim 1 wherein said left bearing hub and said right bearing hub are split bearing hubs.

6. The method of claim 1 wherein said filler material is a castable polymer concrete.

7. A print engine chassis for supporting an imaging drum comprising:

a right wall containing a first cavity adapted for accepting a castable filler material in pliable form wherein said right wall is disposed at a normal with respect to an axis of said imaging drum;

a left wall, disposed opposite said right wall and parallel to said right wall, said left wall containing a second cavity adapted for accepting said filler material in pliable form;

a right bearing hub for supporting said axis of said imaging drum, said right bearing hub held in place by said filler material within said first cavity of said right wall after said filter material hardens; and a left bearing hub for supporting said axis of said imaging drum, said left bearing hub held in place by said filler material within said second cavity of said left wall after said filter hardens.

8. The print engine chassis of claim 7 wherein said filler material is a castable polymer concrete.

9. The print engine chassis of claim 7 wherein said right bearing hub comprises at least one cavity capable of being filled with said filler material.

10. The print engine chassis of claim 7 wherein said right bearing hub and said left bearing hub are axially aligned.

11. The print engine chassis of claim 7 wherein said right bearing hub comprises a split section.

12. The print engine chassis of claim 7 wherein said left bearing hub comprises a split section.

* * * * *